US010731108B2

(12) United States Patent
Wildemuth et al.

(10) Patent No.: US 10,731,108 B2
(45) Date of Patent: Aug. 4, 2020

(54) PROCESSES OF MAKING LIQUID DETERGENT COMPOSITIONS THAT INCLUDE ZWITTERIONIC SURFACTANT

(71) Applicant: The Procter & Gamble Company, Cincinnati, OH (US)

(72) Inventors: Douglas James Wildemuth, Cincinnati, OH (US); Jeffrey Frank Omnitz, Cincinnati, OH (US)

(73) Assignee: The Procter & Gamble Cincinnati OH (US)

( * ) Notice: Subject to any disclaimer, the term of this patent is extended or adjusted under 35 U.S.C. 154(b) by 46 days.

(21) Appl. No.: 15/828,959

(22) Filed: Dec. 1, 2017

(65) Prior Publication Data

US 2019/0169537 A1 Jun. 6, 2019

(51) Int. Cl.

| | |
|---|---|
| ***C11D 11/00*** | (2006.01) |
| ***C11D 1/22*** | (2006.01) |
| ***C11D 1/29*** | (2006.01) |
| ***C11D 1/75*** | (2006.01) |
| ***C11D 1/83*** | (2006.01) |
| ***C11D 1/90*** | (2006.01) |
| ***C11D 1/94*** | (2006.01) |
| ***C11D 1/825*** | (2006.01) |
| ***C11D 17/00*** | (2006.01) |

(52) U.S. Cl.

CPC ..... *C11D 1/94* (2013.01); *C11D 1/825* (2013.01); *C11D 1/83* (2013.01); *C11D 11/0094* (2013.01); *C11D 17/0008* (2013.01); *C11D 1/22* (2013.01); *C11D 1/29* (2013.01); *C11D 1/75* (2013.01)

(58) Field of Classification Search

None

See application file for complete search history.

(56) References Cited

U.S. PATENT DOCUMENTS

| | | | | |
|---|---|---|---|---|
| 5,565,145 | A | 10/1996 | Watson et al. | |
| 6,004,917 | A * | 12/1999 | Akay | B01F 7/00816 510/276 |
| 7,256,167 | B2 * | 8/2007 | Cheung | A01N 59/00 510/235 |
| 8,097,579 | B2 | 1/2012 | Danziger et al. | |
| 8,461,094 | B2 | 6/2013 | Hodson et al. | |
| 8,563,497 | B2 | 10/2013 | Hodson | |
| 8,616,760 | B2 | 12/2013 | Williams et al. | |
| 8,616,761 | B2 | 12/2013 | McLaughlin et al. | |
| 8,853,142 | B2 | 10/2014 | Corominas et al. | |

(Continued)

OTHER PUBLICATIONS

U.S. Appl. No. 15/880,579, filed Jan. 26, 2018, Mark William Hamersky.

(Continued)

*Primary Examiner* — Lorna M Douyon

(74) *Attorney, Agent, or Firm* — Andrés E. Velarde

(57) ABSTRACT

A process of making a liquid detergent composition includes the steps of providing a manufacturing line that includes, in series and in fluid communication, an upstream region, a confluence region, and a downstream region; providing a liquid base composition at the upstream region, where the liquid base composition includes at least one surfactant and at least one detergent adjunct; and combining the liquid base composition with a zwitterionic surfactant, such as amine oxide, in the confluence region, resulting in a detergent composition at the downstream region.

15 Claims, 4 Drawing Sheets

(56) References Cited

U.S. PATENT DOCUMENTS

| | | | | |
|---|---|---|---|---|
| 2007/0044824 | A1 | 3/2007 | Capeci et al. | |
| 2009/0005449 | A1 | 1/2009 | Gunn | |
| 2009/0014029 | A1 | 1/2009 | Borne | |
| 2013/0225468 | A1* | 8/2013 | Corominas | C11D 3/0089 510/299 |
| 2014/0179589 | A1 | 6/2014 | Jones | |
| 2015/0118168 | A1 | 4/2015 | Agerton | |
| 2017/0015942 | A1 | 1/2017 | Iglesias | |
| 2017/0114306 | A1 | 4/2017 | Schulz | |
| 2017/0275573 | A1 | 9/2017 | Uyttersprot | |
| 2018/0062978 | A1 | 3/2018 | Parikh | |
| 2018/0062981 | A1 | 3/2018 | Richley | |
| 2018/0216029 | A1 | 8/2018 | Wildemuth et al. | |
| 2018/0216030 | A1 | 8/2018 | Wildemuth et al. | |
| 2018/0216037 | A1 | 8/2018 | Hamersky et al. | |

OTHER PUBLICATIONS

U.S. Appl. No. 15/417,249, filed Jan. 27, 2017, Douglas James Wildemuth.
U.S. Appl. No. 15/417,250, filed Jan. 27, 2017, Douglas James Wildemuth.
U.S. Appl. No. 15/828,983, filed Dec. 1, 2017, Zhe Julie Xiang.
PCT Search report for appl. No. PCT/US2018/062978, dated Feb. 13, 2019, 11 pages.
PCT Search Report for appl. No. PCT/US2018/062981, dated Feb. 13, 2019, 14 pages.

* cited by examiner

PROCESSES OF MAKING LIQUID DETERGENT COMPOSITIONS THAT INCLUDE ZWITTERIONIC SURFACTANT

FIELD OF THE INVENTION

The present disclosure relates to processes of making liquid detergent compositions that include zwitterionic surfactant.

BACKGROUND OF THE INVENTION

Manufacturers of liquid detergent compositions desire well-mixed products. However, commonly used mixing methods can lead to aerated compositions, where small air bubbles are present, at least temporarily, in the liquid detergent.

Aeration in liquid detergents can pose a variety of challenges to the manufacturer. For example, aeration can cause increased variability in manufacturing systems that rely on volume or density measurements. Such systems are common, for example, in automated filler systems, where portions of the composition are placed into containers, such as bottles that will be sold in a store. Additionally, aeration in externally structured product can lead to product instabilities, believed to be caused by compression of external structurants.

To address the problem of aeration, a manufacturer may employ a two-step process, where a base composition is made in bulk, de-aerated for a period of time, and then finished by adding additional ingredients. The de-aeration process, however, can cost time and capital, and it is desirable, at least, to keep de-aeration time to a minimum.

De-aeration times may be reduced by producing a low-viscosity base composition and/or product compositions, as lower viscosities are associated with decreased aeration times. However, low-viscosity detergent compositions may be runny and thus perceived by the consumer as cheap and poor performing. Therefore, in order to give the consumer a thicker, more luxurious product experience, the manufacturer may add a rheology modifier after the de-aeration process to increase the viscosity of the final product. However, typical rheology modifiers add expense without providing any performance benefits, such as stain removal, in the end product.

In view of the foregoing, there is a need to provide improved liquid detergent manufacturing processes that allow for efficient de-aeration and improved performance benefits.

SUMMARY OF THE INVENTION

The present disclosure relates to processes of making liquid detergent compositions that include zwitterionic surfactant, such as amine oxide.

For example, the present disclosure relates to a process of making a liquid detergent composition that includes the steps of: providing a manufacturing line that includes, in series and in fluid communication, an upstream region, a confluence region, and a downstream region; providing a liquid base composition at the upstream region, where the liquid base composition includes at least one surfactant and at least one detergent adjunct, where the at least one surfactant is selected from anionic surfactant, nonionic surfactant, or mixtures thereof; and combining the liquid base composition with a zwitterionic surfactant, such as amine oxide, in the confluence region, resulting in a detergent composition at the downstream region.

The present disclosure also relates to a process of making a liquid detergent composition that includes the steps of providing a liquid base composition in a storage container, where the liquid base composition includes at least one surfactant and at least one detergent adjunct, where the at least one surfactant is selected from anionic surfactant, nonionic surfactant, or mixtures thereof, and where the liquid base composition has a residence time in the storage container of at least twelve hours; combining a portion of the liquid base composition with a zwitterionic surfactant, such as amine oxide, to form a combined composition; and mixing the combined composition, resulting in a detergent composition.

BRIEF DESCRIPTION OF THE DRAWINGS

The figures herein are illustrative in nature and are not intended to be limiting.

DETAILED DESCRIPTION OF THE INVENTION

Figure 1:
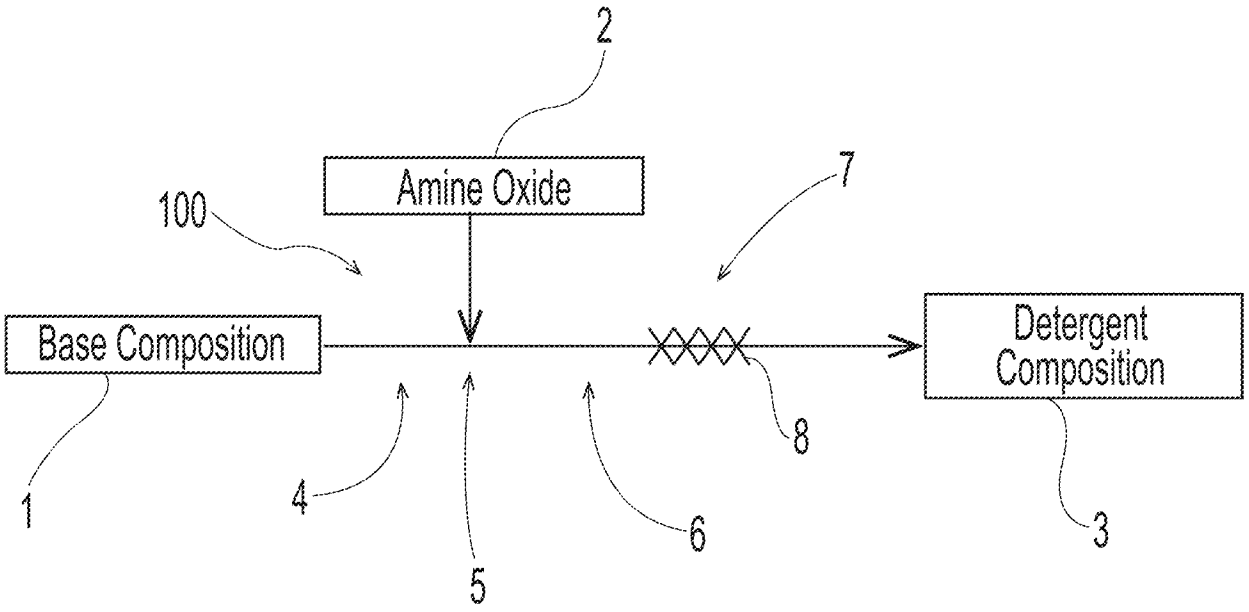
FIG. 1 shows a schematic illustration of the processes of the present disclosure.

The present disclosure relates to processes of making liquid detergent compositions. In brief, a liquid base composition comprising at least one surfactant and at least one detergent adjunct is provided, and is then combined with zwitterionic surfactant, such as amine oxide, resulting in a liquid detergent composition.

Without wishing to be bound by theory, it is believed that the liquid base composition will have a lower viscosity, and thus be better suited to pumping through a manufacturing line and/or to de-aeration processes, than the liquid detergent composition. It is further believed that adding zwitterionic surfactant, such as amine oxide (a detersive surfactant), relatively late in the manufacturing process may help to build viscosity in the final detergent composition while also providing performance benefits, thus providing an improvement over traditional rheology modifiers. Again, without wishing to be bound by theory, it is believed that zwitterionic surfactants, such as amine oxide, can form worm-like micelles in certain formulations, thereby building viscosity in a liquid detergent composition. In particular, it is believed that detergent compositions having relatively high levels of water and relatively low levels of solvent may be particularly sensitive to viscosity building due to salts and/or zwitterionic surfactants such as amine oxide, so controlling the relative amounts and/or where in the process they are added can provide significant processing benefits.

The process and compositions of the present disclosure are described in more detail below.

As used herein, the articles "a" and "an" when used in a claim, are understood to mean one or more of what is claimed or described. As used herein, the terms "include," "includes," and "including" are meant to be non-limiting.

The compositions of the present disclosure can comprise, consist essentially of, or consist of, the components of the present disclosure.

The terms "substantially free of" or "substantially free from" may be used herein. This means that the indicated material is at the very minimum not deliberately added to the composition to form part of it, or, preferably, is not present at analytically detectable levels. It is meant to include compositions whereby the indicated material is present only as an impurity in one of the other materials deliberately included. The indicated material may be present, if at all, at a level of less than 1%, or less than 0.1%, or less than 0.01%, or even 0%, by weight of the composition.

As used herein, the phrase "surface care composition" means a composition suitable for treating a surface. Suitable surfaces to be treated may include textiles such as fabrics, including articles to be laundered; hard surfaces such as dishware (including glassware and flatware), countertops, tile and other hard flooring, and bathroom fixtures such as sinks, toilets, and bathtubs/showers; hair; and skin. Surface care compositions may include fabric care compositions, dish care compositions, hard surface cleaning compositions, hair care compositions, skin care compositions, or mixtures thereof.

As used herein the phrase "fabric care composition" includes compositions and formulations designed for treating fabric. Such compositions include but are not limited to, laundry cleaning compositions and detergents, fabric softening compositions, fabric enhancing compositions, fabric freshening compositions, laundry prewash, laundry pretreat, laundry additives, spray products, dry cleaning agent or composition, laundry rinse additive, wash additive, post-rinse fabric treatment, ironing aid, unit dose formulation, delayed delivery formulation, detergent contained on or in a porous substrate or nonwoven sheet, and other suitable forms that may be apparent to one skilled in the art in view of the teachings herein. Such compositions may be used as a pre-laundering treatment, a post-laundering treatment, or may be added during the rinse or wash cycle of the laundering operation.

Unless otherwise noted, all component or composition levels are in reference to the active portion of that component or composition, and are exclusive of impurities, for example, residual solvents or by-products, which may be present in commercially available sources of such components or compositions.

All temperatures herein are in degrees Celsius (° C.) unless otherwise indicated. Unless otherwise specified, all measurements herein are conducted at 20° C. and under the atmospheric pressure.

In all embodiments of the present disclosure, all percentages are by weight of the total composition, unless specifically stated otherwise. All ratios are weight ratios, unless specifically stated otherwise.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

Method of Making

The present disclosure relates to a process of making a liquid detergent composition. The liquid detergent composition may be a household care composition, as described in more detail below.

Figure 2:
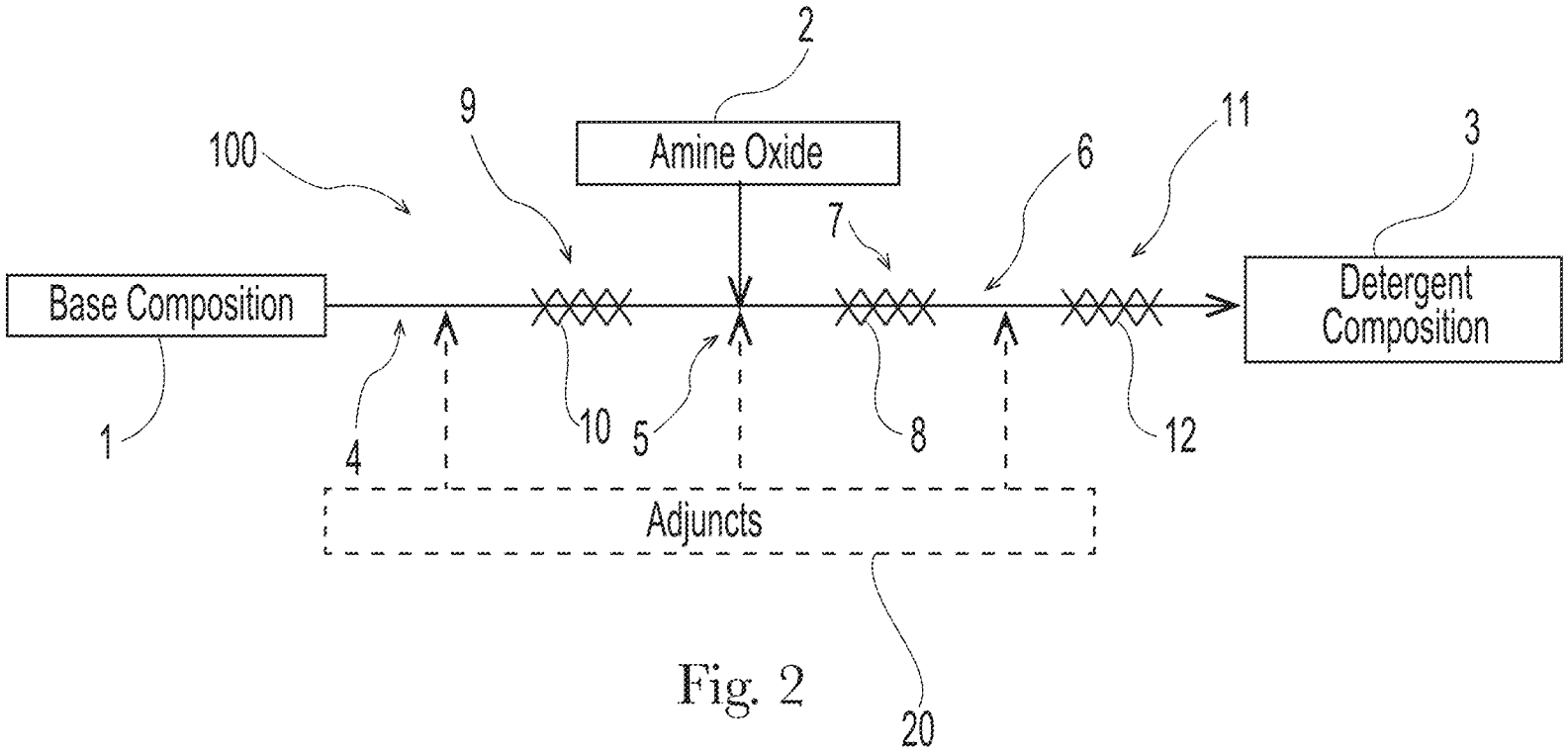
FIG. 2 shows a schematic illustration of the processes of the present disclosure, including optional addition of adjunction ingredients.

As shown schematically in FIGS. 1 and 2, the present processes may include providing a manufacturing line 100 suitable for manufacturing a liquid detergent composition 3. The manufacturing line may include, preferably in series, an upstream region 4, a confluence region 5, and a downstream region 6. The regions 4, 5, 6 may be in fluid communication with one another, for example so that a fluid may travel from the upstream region 4, to the confluence region 5, to the downstream region 6. The process may include the step of providing a base composition 1 at the upstream region 4, combining the liquid base composition 1 with a zwitterionic surfactant, such as an amine oxide surfactant 2, in the confluence region 5, and thereby resulting in a detergent composition 3 at the downstream region 6.

As schematically shown in FIG. 2, the processes of the present disclosure may further include the step(s) of adding one or more additional detergent adjuncts 20 to the liquid base composition 1, the detergent composition 3, or both. The adjuncts may be added in the upstream region 4, the confluence region 5, or the downstream region 6. The resulting compositions may be mixed in mixing zones 7, 9, 11, for example with static mixers 8, 10, 12.

The manufacturing line 100 may include, for example, a common pipe, a common mixing vessel, and/or a common conveyor system.

Figure 3:
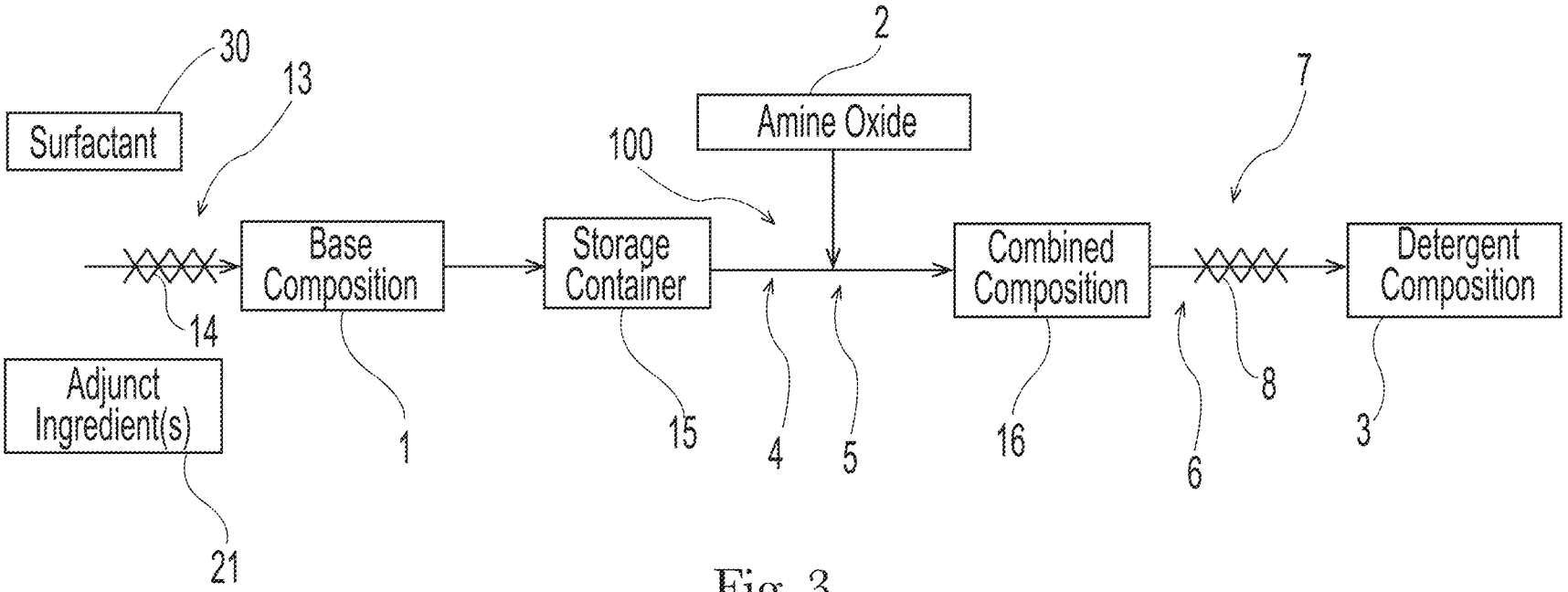
FIG. 3 shows a schematic illustration of the processes of the present disclosure, including the step of storing a base composition in a storage container.

As shown schematically in FIG. 3, the present processes may include providing a base composition 1 in a storage container 15, such as a storage tank. The container 15 may be suitable for industrial usage and may have an interior volume of from about 1000 L to about 1,000,000 L, or from about 5000 L to about 500,000 L. The base composition 1 may have a residence time in the storage container 15. The residence time may be selected so that the base composition 1 can sufficiently de-aerate. Typically, it is preferred that the time for de-aeration is kept to a minimum. The residence time may be at least about twelve hours. The residence time may be no longer than about seventy-two hours, or no longer than about forty-eight hours, or no longer than about twenty-four hours. The present processes may include the step of moving, for example by pumping, at least a portion of the base composition 1 from the storage container 15 to the upstream region 4 of the manufacturing line 100 described above.

The processes of the present disclosure may further include a filling step. The filling step may include placing the detergent composition into a container, which may occur at a location on the manufacturing line further downstream of the downstream region. The filling step may occur less than about ten minutes after the zwitterionic surfactant, such as amine oxide surfactant, is added to the liquid base composition. The container of the filling step may be a pouch or a bottle, which may be suitable for selling to a consumer. Multiple containers may be packaged into secondary packaging, such as in box or on a pallet.

The steps, compositions, and component ingredients of the present disclosure are described in more detail below.

Base Composition

The present processes may include the step of providing a liquid base composition. The components of the liquid base composition are suitable for inclusion in the final household care composition(s).

The liquid base composition may be partially or completely prepared and stored prior to beginning making the liquid detergent compositions of the present disclosure. The liquid base composition may be stored and then later modified by adding adjunct ingredients, prior to combining the base composition with the amine oxide. The liquid base composition may be made during an in-line process prior to combining the base composition with the amine oxide.

As shown in FIG. 3, the processes of the present disclosure may include the step of preparing the liquid base composition 1 by combining at least one surfactant 30 and at least one detergent adjunct 21 and mixing. Suitable surfactants and adjuncts are described in more detail below. The mixing step may be via any suitable mixing process, or with any suitable mixing apparatus. For example, the mixing process may be a batch mixing process, or an in-line mixing process. The mixing process may comprise dynamic mixing and/or static mixing in a mixing zone 13, for example via the use of static mixers 14.

The mixing process may introduce aeration into the liquid base composition. Therefore, it may be beneficial to store the liquid base composition to allow for de-aeration of the composition. For example, the liquid base composition may be stored, e.g. in a storage tank, for at least six hours, or at least twelve hours, or at least eighteen hours, or at least twenty-four hours, and optionally up to forty-eight hours, or up to seventy-two hours, prior to the step of being combined with amine oxide surfactant.

The liquid base composition may be characterized by a greater degree of aeration before storage compared to after storage. The degree of aeration of the composition before storage may be from about 2% to about 12%, or from about 3% to about 8%. The degree of aeration of the composition after storage may be less than 2%, or less than or equal to about 1.5%, or less than or equal to about 1%. The density of a liquid composition may be used as proxy for relative aeration, as compositions having a higher degree of aeration will have a lower density compared to an otherwise equivalent composition having a lower degree of aeration. The density of the composition may be less than the density of the composition after storage, typically due to de-aeration of the composition. The composition after storage may not be completely de-aerated. To note, many filling processes ultimately rely on the density of a final product composition (e.g., a particular mass of a composition is expected to provide a particular volume of the composition), and an over-aerated product may result in overfilling a product container.

As shown in FIG. 3, the liquid base composition 1 may be stored in a storage container 15 and then transported, e.g., by pumping through one or more pipes, to where the base composition 1 will be combined with the amine oxide surfactant 2. The liquid base composition 1 may be provided at an upstream region 4 of a manufacturing line 100.

The liquid base composition may be provided as a first amount and a second amount. The first and second amounts may be any suitable volume for the amount of resulting household care composition that is desired. For example, the volume may be sufficient to fill a single bottle (e.g., 1 liter) or sufficient to run a manufacturing line at full capacity for one or more days (e.g., 1000s of liters or more).

The liquid base composition may be characterized by a viscosity. The base composition may have a first viscosity that is from about 50 to about 300 cps.

The liquid base composition may be characterized by a pH of from about 2 to about 12. The liquid base composition may be characterized by a basic pH, for example a pH of from about 7.5, or from about 8, or from about 9, or from about 10, to about 12, or to about 11, or to about 10. The liquid base composition may be characterized by a pH of from about 9 to about 12, or from about 8 to about 9. The liquid base composition may be characterized by an acidic pH.

The liquid base composition may be substantially unbuffered. The liquid base composition may be substantially free of buffering agents, such as citric acid, acetic acid, lactic acid, a borate derivative, fatty acid, alkanolamine, a caustic hydroxide compound (e.g., NaOH), a carbonate, a zeolite, or mixtures thereof. As used herein, the liquid base composition may be substantially free of buffering agents, other than compounds present in amounts necessary to neutralize acid-forms of the present surfactants.

The liquid base composition may include detersive surfactant. The base composition may include from about 1%, or from about 5%, or from about 10%, or from about 15%, or from about 20%, and optionally up to about 75%, or up to about 60%, or up to about 50%, or up to about 40%, or up to about 30%, or up to about 25%, by weight of the base composition, of detersive surfactant. The liquid base composition may include from about 15% to about 30% of detersive surfactant.

The detersive surfactant may be selected from anionic surfactants, nonionic surfactants, cationic surfactants, amphoteric surfactants, ampholytic surfactants, and mixtures thereof. Those of ordinary skill in the art will understand that a detersive surfactant encompasses any surfactant or mixture of surfactants that provide cleaning, stain removing, or laundering benefit to soiled material. As used herein, fatty acids and their salts are understood to be part of the surfactant system.

The detersive surfactant may include anionic surfactant. Anionic surfactant may be present in the largest proportion of all the surfactants present in the base composition. Non-limiting examples of suitable anionic surfactants include any conventional anionic surfactant. This may include a sulfate detersive surfactant, for e.g., alkoxylated and/or non-alkoxylated alkyl sulfate materials, and/or sulfonic detersive surfactants, e.g., alkyl benzene sulfonates. The liquid base composition may comprise anionic surfactant selected from alkyl alkoxylated sulfate, alkyl sulfate, alkyl benzene sulphonate, or mixtures thereof. The surfactant may comprise alkyl ethoxylated sulfate and alkyl benzene sulphonate.

Suitable anionic surfactants may be derived from renewable resources, waste, petroleum, or mixtures thereof. Suitable anionic surfactants may be linear, partially branched, branched, or mixtures thereof.

The anionic surfactants may exist in an acid form, and the acid form may be neutralized to form a surfactant salt. Typical agents for neutralization include metal counterion bases, such as hydroxides, e.g., NaOH or KOH. Further suitable agents for neutralizing anionic surfactants in their acid forms include ammonia, amines, or alkanolamines. Non-limiting examples of alkanolamines include monoethanolamine, diethanolamine, triethanolamine, and other linear or branched alkanolamines known in the art; suitable alkanolamines include 2-amino-1-propanol, 1-aminopropanol, monoisopropanolamine, or 1-amino-3-propanol. Amine neutralization may be done to a full or partial extent, e.g., part of the anionic surfactant mix may be neutralized with sodium or potassium and part of the anionic surfactant mix may be neutralized with amines or alkanolamines.

The detersive surfactant may include nonionic surfactant. Suitable nonionic surfactants include alkoxylated fatty alcohols. The nonionic surfactant may be selected from ethoxylated alcohols and ethoxylated alkyl phenols of the formula $R(OC_2H_4)_nOH$, wherein R is selected from the group consisting of aliphatic hydrocarbon radicals containing from about 8 to about 15 carbon atoms and alkyl phenyl radicals in which the alkyl groups contain from about 8 to about 12 carbon atoms, and the average value of n is from about 5 to about 15.

Other non-limiting examples of nonionic surfactants useful herein include: $C_8$-$C_{18}$ alkyl ethoxylates, such as, NEODOL® nonionic surfactants from Shell; $C_6$-$C_{12}$ alkyl phenol alkoxylates where the alkoxylate units may be ethyleneoxy units, propyleneoxy units, or a mixture thereof; $C_{12}$-$C_{18}$ alcohol and $C_6$-$C_{12}$ alkyl phenol condensates with ethylene oxide/propylene oxide block polymers such as Pluronic® from BASF; $C_{14}$-$C_{22}$ mid-chain branched alcohols, BA; $C_{14}$-$C_{22}$ mid-chain branched alkyl alkoxylates, BAE, wherein x is from 1 to 30; alkylpolysaccharides; specifically alkylpolyglycosides; polyhydroxy fatty acid amides; and ether capped poly(oxyalkylated) alcohol surfactants.

The detersive surfactant may include a cationic surfactant. Non-limiting examples of cationic surfactants include: the quaternary ammonium surfactants, which can have up to 26 carbon atoms include: alkoxylate quaternary ammonium (AQA) surfactants; dimethyl hydroxyethyl quaternary ammonium; dimethyl hydroxyethyl lauryl ammonium chloride; polyamine cationic surfactants; cationic ester surfactants; and amino surfactants, e.g., amido propyldimethyl amine (APA). Suitable cationic detersive surfactants also include alkyl pyridinium compounds, alkyl quaternary ammonium compounds, alkyl quaternary phosphonium compounds, alkyl ternary sulphonium compounds, and mixtures thereof. Suitable cationic detersive surfactants are mono-$C_{6-18}$ alkyl mono-hydroxyethyl di-methyl quaternary ammonium chlorides. Highly suitable cationic detersive surfactants are mono-$C_{8-10}$ alkyl mono-hydroxyethyl di-methyl quaternary ammonium chloride, mono-$C_{10-12}$ alkyl mono-hydroxyethyl di-methyl quaternary ammonium chloride and mono-$C_{10}$ alkyl mono-hydroxyethyl di-methyl quaternary ammonium chloride.

The detersive surfactant may include an amphoteric surfactant. Examples of amphoteric surfactants include aliphatic derivatives of secondary or tertiary amines, or aliphatic derivatives of heterocyclic secondary and tertiary amines in which the aliphatic radical may be straight or branched-chain and where one of the aliphatic substituents contains at least about 8 carbon atoms, or from about 8 to about 18 carbon atoms, and at least one of the aliphatic substituents contains an anionic water-solubilizing group, e.g. carboxy, sulfonate, sulfate. Suitable amphoteric surfactants also include sarcosinates, glycinates, taurinates, and mixtures thereof.

The liquid base composition may include other ingredients, such as water, nonaminofunctional solvent, and/or additional adjunct ingredients.

The liquid base composition may comprise water, for example from about 10%, or from about 20%, or from about 25%, or from about 35%, to about 80%, or to about 75%, or to about 70%, or to about 60%, or to about 50%, by weight of the liquid base composition, of water.

The liquid base composition may comprise non-aminofunctional organic solvent. As used herein, "non-aminofunctional organic solvent" refers to any suitable organic solvent which contains no amino functional groups. Suitable non-aminofunctional organic solvents may include monohydric alcohols, dihydric alcohols, polyhydric alcohols, glycerol, glycols, polyalkylene glycols such as polyethylene glycol, and mixtures thereof. The compositions of the present disclosure may include mixtures of solvents, such as mixtures of two or more of the following: lower aliphatic alcohols such as ethanol, propanol, butanol, isopropanol; diols such as 1,2-propanediol or 1,3-propanediol; and glycerol. The compositions of the present disclosure may include solvents that include propanediols but not methanol and/or ethanol. The non-aminofunctional organic solvents may be liquid at ambient temperature and pressure (i.e. 21° C. and 1 atmosphere), and may comprise carbon, hydrogen and oxygen. Non-aminofunctional organic solvents may also be added as adjunct ingredients according to the present processes. The liquid base composition may include no more than about 15%, or not more than about 10%, or no more than about 5%, by weight of the liquid base composition, of non-aminofunctional organic solvent. It may be desirable to limit the amount of solvent in the base composition, as such solvents provide little performance benefit in final product.

It is known that salts tend to increase the viscosity of compositions, particularly those that include water. Therefore, the liquid base composition may have limited levels of salts, for example no more than about 10%, or no more than about 5%, by weight of the liquid base composition. Such low levels may help to keep the viscosity of the liquid base composition relatively low. Salts may alkali metal and/or alkali earth metal chlorides, formates, citrates, and/or carbonates. Other salts may include materials used as builders and/or chelants, such as DTPA, HEDP, and/or EDDS. As used in this section, the level of salts does not include neutralized surfactants.

The liquid base composition may include additional adjunct ingredients, as described below.

Zwitterionic Surfactant

The processes and compositions of the present disclosure may include zwitterionic surfactants, such as amine oxide. Zwitterionic surfactants can provide useful performance benefits in a final detergent composition or product, such as stain removal benefits; for example, amine oxide is believed to be particularly useful for helping to remove greasy stains. Known processes of making detergent compositions include making a base composition with surfactants, including zwitterionic surfactants such as amine oxide surfactants, and then adding adjuncts relatively late in the manufacturing process to make a final detergent product. However, such base compositions may have relatively high viscosities and can present challenges to the manufacturer. Processes according to the present disclosure may include combining a liquid base detergent composition and a zwitterionic surfactant.

As shown in FIGS. 1-3, the processes of the present disclosure may include providing a liquid base composition 1 and combining the liquid base composition 1 with zwitterionic surfactant such as amine oxide surfactant 2. This combining step may occur relatively late in the manufacturing process. In addition to providing stain removal performance benefits, zwitterionic surfactant such as amine oxide, when added to a liquid base composition as described in the present disclosure, can help to build viscosity in the resulting composition. Thus, the liquid base composition may have a relatively low viscosity, which can speed deaeration times and/or require less energy to pump the base composition through a manufacturing line, while the final detergent composition, where zwitterionic surfactant (e.g., amine oxide) was added relatively late in the manufacturing process, can have a relatively greater viscosity, improved performance, and a more efficient use of formulation space than if other rheology modifiers were used.

The processes of the present disclosure may include combining a portion of the liquid base composition 1 with a zwitterionic surfactant such as amine oxide surfactant 2 to form a combined composition 16. The processes may include mixing the combined composition 16, which may result in a detergent composition 3. The mixing step may occur in a mixing zone 7 and may include any suitable mixing apparatus, including one or more static mixers 8.

This combining step may occur in the confluence region 5 of a manufacturing line 100. A liquid detergent composition 3 may result at a downstream region 6 of the manufacturing line 100.

Examples of zwitterionic surfactants include: derivatives of secondary and tertiary amines, derivatives of heterocyclic secondary and tertiary amines, or derivatives of quaternary ammonium, quaternary phosphonium or tertiary sulfonium compounds. Suitable examples of zwitterionic surfactants include betaines, including alkyl dimethyl betaine and cocodimethyl amidopropyl betaine, amine oxides (for example $C_8$ to $C_{18}$, or $C_{12}$ to $C_{18}$) amine oxides, and sulfo and hydroxy betaines, such as N-alkyl-N,N-dimethylammino-1-propane sulfonate where the alkyl group can be $C_8$ to $C_{18}$. The zwitterionic surfactant may be amine oxide surfactant.

Suitable amine oxides may include alkyl dimethyl amine oxide or alkyl amido propyl dimethyl amine oxide, more preferably alkyl dimethyl amine oxide and especially coco dimethyl amino oxide. Amine oxide may have a linear or mid-branched alkyl moiety. Typical linear amine oxides include water-soluble amine oxides containing one R1 C8-18 alkyl moiety and 2 R2 and R3 moieties selected from the group consisting of C1-3 alkyl groups and $C_{1-3}$ hydroxyalkyl groups. Preferably amine oxide is characterized by the formula R1-N(R2)(R3)O wherein R1 is a C8-18 alkyl and R2 and R3 are selected from the group consisting of methyl, ethyl, propyl, isopropyl, 2-hydroxethyl, 2-hydroxypropyl and 3-hydroxypropyl. The linear amine oxide surfactants in particular may include linear C10-C18 alkyl dimethyl amine oxides and linear C8-C12 alkoxy ethyl dihydroxy ethyl amine oxides. Preferred amine oxides include linear C10, linear C10-C12, and linear C12-C14 alkyl dimethyl amine oxides. As used herein "mid-branched" means that the amine oxide has one alkyl moiety having n1 carbon atoms with one alkyl branch on the alkyl moiety having n2 carbon atoms. The alkyl branch is located on the a carbon from the nitrogen on the alkyl moiety. This type of branching for the amine oxide is also known in the art as an internal amine oxide. The total sum of n1 and n2 is from 10 to 24 carbon atoms, preferably from 12 to 20, and more preferably from 10 to 16. The number of carbon atoms for the one alkyl moiety (n1) should be approximately the same number of carbon atoms as the one alkyl branch (n2) such that the one alkyl moiety and the one alkyl branch are symmetric. As used herein "symmetric" means that $|n1-n2|$ is less than or equal to 5, preferably 4, most preferably from 0 to 4 carbon atoms in at least 50 wt %, more preferably at least 75 wt % to 100 wt % of the mid-branched amine oxides for use herein.

The amine oxide may further comprise two moieties, independently selected from a C1-3 alkyl, a C1-3 hydroxyalkyl group, or a polyethylene oxide group containing an average of from about 1 to about 3 ethylene oxide groups. Preferably the two moieties are selected from a C1-3 alkyl, more preferably both are selected as a C1 alkyl.

The amine oxide that is combined with the base detergent may be in the form of an aqueous solution. The aqueous solution may include water and amine oxide, where amine oxide is present at a level of from about 10% to about 50%, or from about 20% to about 40%, by weight of the aqueous solution, of amine oxide. The amine oxide may be combined with other organic solvents, but water is typically preferred, for cost and/or volatility reasons. The aqueous composition comprising amine oxide may have a viscosity of from about 50 to about 300 cps, or to about 200 cps, or to about 150 cps.

The zwitterionic surfactant, such as amine oxide, may be combined with the base detergent (and optionally other adjuncts) in such an amount so as to provide a detergent composition that includes from about 0.1% to about 2%, or to about 1.5%, or to about 1%, or to about 0.75%, or to about 0.5%, by weight of the detergent composition, of zwitterionic surfactant, e.g. amine oxide surfactant.

The zwitterionic surfactant (e.g., amine oxide) may be combined with the base detergent in such an amount so that the weight ratio of the at least one surfactant, preferably the total amount of surfactant, of the liquid base composition to the zwitterionic surfactant (e.g., amine oxide surfactant) is at least about 5:1, and preferably less than about 200:1.

Liquid Detergent Composition

The processes of the present disclosure may result in a liquid detergent composition. For example, combining a liquid base composition 1 with a zwitterionic surfactant such as an amine oxide surfactant 2, for example, in a confluence region 5 of a manufacturing line 100, may result in a detergent composition 3, for example at a downstream region 6 of the manufacturing line. A liquid detergent composition 3 may result from mixing a combined composition 16, the combined composition 16 resulting from combining the liquid base composition 1 and the zwitterionic surfactant, such as amine oxide 2.

Typically, the addition of the amine oxide results in a detergent composition that has a viscosity that is greater than the viscosity of the liquid base composition. The base composition may be characterized by a first viscosity. The detergent composition may be characterized by a second viscosity. The second viscosity may be greater than the first viscosity. The second viscosity may be at least about 125%, or at least about 150%, or at least about 200%, of the first viscosity. The base composition may have a first viscosity that is from about 50 to about 300 cps. The detergent composition may have a second viscosity of from about 300 to about 1000 cps.

The viscosity of the detergent composition may be greater than the viscosity of the zwitterionic surfactant such as amine oxide (and/or aqueous composition thereof) that is combined with the liquid base composition. It is believed that when the zwitterionic surfactant such as amine oxide is combined with the base detergent composition, worm-like micelles may form and build viscosity, resulting in a liquid detergent composition that is characterized by a viscosity that is greater than the viscosity of the base composition and/or the zwitterionic surfactant, such as amine oxide composition.

The liquid detergent composition may be liquid surface care compositions, such as fabric care compositions, dish care compositions, hard surface cleaner compositions, hair care compositions, skin care compositions, or mixtures thereof. The liquid detergent compositions of the present disclosure may be fabric care compositions, dish care compositions, or mixtures thereof. The dish care compositions may be dish care compositions suitable for hand-washing and/or for washing in an automatic dishwasher.

The liquid detergent compositions of the present disclosure may include additional adjunct ingredients. These ingredients may be present in the liquid base composition as provided, or they may be added during the processes described herein. The processes of the present disclosure may include the step(s) of adding one or more additional detergent adjuncts to the liquid base composition, to the detergent composition, or to both. For example, adjunct ingredients may be added before, during, or after the zwitterionic surfactant (e.g., amine oxide) composition has been combined with the base composition. FIG. 2, for example, schematically shows that adjunct ingredients 20 may be optionally added before or after the zwitterionic surfactant (e.g., the amine oxide 2) is combined with the base composition 3.

Any adjunct ingredient suitable for the final form and intended end-use of the described household care compositions may be added at any suitable point of the present processes. The adjunct ingredients may be added at a level suitable to provide a performance benefit. The adjunct ingredients may be present, individually or collectively, in the compositions of the present disclosure at a level of from about 0.00001%, or from about 0.0001%, or from about 0.001%, or from about 0.01%, or from about 0.1%, or from about 1%, to about 50%, or to about 40%, or to about 30%, or to about 20%, or to about 15%, or to about 10%, or to about 8%, or to about 6%, or to about 5%, or to about 4%, or to about 3%, or to about 2%, or to about 1%, by weight of the composition. The adjunct ingredient may be present at a level of from about 0.001% to about 10%, by weight of the composition.

The liquid household care compositions described herein may include one or more of the following non-limiting list of ingredients: fabric care benefit agent; detersive enzyme; deposition aid; rheology modifier; builder; chelant; bleach; bleaching agent; bleach precursor; bleach booster; bleach catalyst; perfume and/or perfume microcapsules; perfume loaded zeolite; starch encapsulated accord; polyglycerol esters; whitening agent; pearlescent agent; enzyme stabilizing systems; scavenging agents including fixing agents for anionic dyes, complexing agents for anionic surfactants, and mixtures thereof; optical brighteners or fluorescers; polymer including but not limited to soil release polymer and/or soil suspension polymer; dispersants; antifoam agents; non-aqueous solvent; fatty acid; suds suppressors, e.g., silicone suds suppressors; cationic starches; scum dispersants; substantive dyes; colorants; opacifier; antioxidant; hydrotropes such as toluenesulfonates, cumenesulfonates and naphthalenesulfonates; color speckles; colored beads, spheres or extrudates; clay softening agents; anti-bacterial agents. Additionally or alternatively, the compositions may comprise surfactants, quaternary ammonium compounds, and/or solvent systems. Quaternary ammonium compounds may be present in fabric enhancer compositions, such as fabric softeners, and comprise quaternary ammonium cations that are positively charged polyatomic ions of the structure $NR_4^+$, where R is an alkyl group or an aryl group.

The compositions disclosed herein may comprise an adjunct selected from the group consisting of a structurant, a builder, an organic polymeric compound, an enzyme, an enzyme stabilizer, a bleach system, a brightener, a hueing agent, a chelating agent, a suds suppressor, a conditioning agent, a humectant, neat perfume, encapsulated benefit agent (such as perfume encapsulates), a filler or carrier, and mixtures thereof. The compositions of the present disclosure may comprise an adjunct selected from encapsulates, neat perfume, enzymes, fabric hueing agents, conditioning agents, fabric enhancement polymers, pearlescent agents, opacifiers, or mixtures thereof.

The compositions of the present disclosure may further comprise a structurant or thickener which may be useful to maintain the non-homogeneity of the present compositions, e.g., by "locking" the components into place. Structurants may also be useful to maintain stability and/or to suspend benefit agents. Suitable structurants/thickeners may include non-polymeric crystalline hydroxyl-functional materials, such as a crystallizable glyceride (e.g., hydrogenated castor oil or derivatives thereof). It may be that the base composition does not comprise an external structurant. External structurant may be added after the zwitterionic surfactant (e.g., amine oxide) has been added. The viscosity of the composition formed from combining the liquid base composition and the zwitterionic surfactant (e.g., amine oxide) may have approximately the same viscosity (e.g. +/−about 50%) as the external structurant before the external structurant is added. Having similar viscosities can improve the ease with which the external structurant is incorporated into the detergent composition (e.g., via more efficient mixing).

The liquid detergent composition may be characterized by a pH. The pH may be an acidic pH or a basic pH, preferably a basic pH. The pH may be from about 7.5 to about 11, or to about 10, or to about 9, or to about 8.5. The pH of the liquid detergent composition may be different from the pH of the liquid base composition, preferably less than the pH of the liquid base composition. A buffering agent may be present in the base composition, added to the base composition before the zwitterionic surfactant (e.g., amine oxide), or may be added to the detergent composition after the zwitterionic surfactant (e.g., amine oxide) has been combined with the base composition. Suitable buffering agents are described above.

The processes of the present disclosure may include one or more finishing steps, in which certain adjunct ingredients are added, e.g., downstream from the confluence zone, after the base composition has been combined with the zwitterionic surfactant (e.g., amine oxide), to result in the final household care composition(s). For example, the finishing step may comprise adding aesthetic ingredients, such as neat perfume and/or (aesthetic) dye. The finishing step may include adding encapsulated benefit agents, such as perfume encapsulates; a structuring agent may be added before or after the encapsulated benefit agent is added, preferably after. The finishing step may comprise mixing the household care composition, for example, with a static mixer.

The liquid detergent compositions of the present disclosure may include at least about 50%, or at least about 60%, or at least about 70%, or at least about 75%, or at least about 80%, by weight of the composition, of water.

The processes of the present disclosure also contemplate making a plurality of liquid detergent compositions, including at least a first detergent composition and a second detergent composition, wherein the first and second detergent compositions are compositionally different. It may be advantageous to the manufacturer to begin with a single base composition and then add different types and/or amounts of ingredients to form at least two different types of detergents, as starting with a single base composition may reduce complexity and/or capital requirements.

For example, the process may include the steps of providing a first portion of the base composition and combining the first portion with a zwitterionic surfactant, e.g., an amine oxide surfactant, thereby resulting in a first detergent composition. The process may further include providing a second portion of the base composition and adding one or more ingredients, such as zwitterionic surfactant (e.g., amine oxide surfactant) and/or adjunct ingredients, thereby providing a second detergent composition that is compositionally different from the first detergent composition. The second detergent may be made compositionally different, for example, by providing a different amount of zwitterionic surfactant such as amine oxide (more, less, or even none at all) to the second portion of base detergent as compared to the first portion. Additionally or alternatively, the second detergent may be made compositionally different by providing different types and/or amounts of surfactants, adjunct ingredients, or mixtures thereof to the second portion of the base composition and/or to the second detergent composition. For example, different perfume and/or perfume encapsulates may be added to the second detergent composition.

The processes of the present disclosure may include a filling step. The filling step may include disposing at least a portion of the household care compositions in a container. The container may be a storage container, a transport container, or a container suitable for sale to a consumer, such as a bottle or bag. Multiple containers may be bundled for transport, such as multiple bottles in a box or on a pallet.

Methods of Use

The household care compositions made by the present processes may be used for their intended end-use according to known methods. For example, fabric care compositions may be used to treat a fabric, for example by contacting a fabric with a wash liquor comprising water and a portion of the fabric care composition. Dish washing compositions may be used to treat, e.g., dirty dishes, glassware, and/or flatware by contacting the dishes, etc., with an aqueous mixture of water and the dish washing composition. Manual and automatic (e.g., with a suitable machine) treatment processes are contemplated by the present disclosure.

Combinations

Specifically contemplated combinations of the disclosure are herein described in the following lettered paragraphs. These combinations are intended to be illustrative in nature and are not intended to be limiting.

A. A process of making a liquid detergent composition, the process comprising the steps of: providing a manufacturing line comprising, in series and in fluid communication, an upstream region, a confluence region, and a downstream region; providing a liquid base composition at the upstream region, the liquid base composition comprising at least one surfactant and at least one detergent adjunct, wherein the at least one surfactant is selected from anionic surfactant, nonionic surfactant, or mixtures thereof; and combining the liquid base composition with a zwitterionic surfactant in the confluence region, thereby resulting in a detergent composition at the downstream region.

B. A process according to paragraph A, wherein the process further comprises adding one or more additional detergent adjuncts to the liquid base composition, the detergent composition, or both.

C. A process according to any of paragraphs A-B, wherein the at least one detergent adjunct comprises a builder, an organic polymeric compound, an enzyme, an enzyme stabilizer, a bleach system, a brightener, a hueing agent, a chelating agent, a suds suppressor, a conditioning agent, a humectant, neat perfume, encapsulated benefit agents, a filler or carrier, or mixtures thereof.

D. A process according to any of paragraphs A-C, wherein the liquid base composition comprises from about from about 1% to about 75%, by weight of the liquid base composition, of surfactant.

E. A process according to any of paragraphs A-D, wherein the surfactant comprises anionic surfactant selected from alkyl alkoxylated sulfate, alkyl sulfate, alkyl benzene sulphonate, or mixtures thereof.

F. A process according to any of paragraphs A-E, wherein the surfactant comprises alkyl ethoxylated sulfate and alkyl benzene sulphonate.

G. A process according to any of paragraphs A-F, wherein the zwitterionic surfactant is selected from the group consisting of betaine surfactant, amine oxide surfactant, and mixture thereof.

H. A process according to any of paragraphs A-G, wherein the zwitterionic surfactant comprises amine oxide surfactant, preferably alkyl dimethyl amine oxide surfactant, more preferably $C_{10}$-$C_{18}$ dimethyl alkyl amine oxide.

I. A process according to any of paragraphs A-H, wherein the weight ratio of the at least one surfactant of the liquid base composition to the zwitterionic surfactant is at least about 5:1.

J. A process according to any of paragraphs A-I, wherein the detergent composition comprises from about 0.1% to about 2%, by weight of the detergent composition, of zwitterionic surfactant.

K. A process according to any of paragraphs A-J, wherein the base composition has a first viscosity, and wherein the detergent composition has a second viscosity that is greater than the first viscosity.

K. A process according to paragraph J, wherein the second viscosity is at least about 125%, or at least about 150%, or at least about 200% of the first viscosity.

L. A process according any of paragraphs J-K, wherein the first viscosity is from about 50 to about 300 cps.

M. A process according to any of paragraphs J-L, wherein the second viscosity is from about 300 to about 1000 cps.

N. A process according to any of paragraphs A-M, wherein the base composition does not comprise an external structurant, and wherein an external structurant is added after the zwitterionic surfactant has been added.

O. A process according to any of paragraphs A-H, wherein the process further comprises a filling step, wherein the detergent composition is placed into a container at a location further downstream of the downstream region, preferably wherein the filling step occurs less than about 10 minutes after the amine oxide surfactant is added to the liquid base composition.

P. A process of making a liquid detergent composition, the process comprising the steps of: providing a liquid base composition in a storage container, wherein the liquid base composition comprises at least one surfactant and at least one detergent adjunct, wherein the at least one surfactant is selected from anionic surfactant, nonionic surfactant, or mixtures thereof, and wherein the liquid base composition has a residence time in the storage container of at least twelve hours; combining a portion of the liquid base composition with a zwitterionic surfactant to form a combined composition; and mixing the combined composition, resulting in a detergent composition.

Q. A process according to paragraph P, further comprising the step of preparing the liquid base composition by combining the at least one surfactant and the at least one detergent adjunct and mixing.

R. A process according to any of paragraphs P-Q, wherein the residence time in the storage container is at least twelve hours and no more than seventy-two hours.

S. A process according to any of paragraphs P-R, wherein the zwitterionic surfactant comprises amine oxide surfactant.

T. A process according to any of paragraphs P-S, wherein the base composition has a first viscosity, and wherein the detergent composition has a second viscosity that is greater than the first viscosity, preferably wherein the second viscosity is at least about 150% of the first viscosity.

U. A process according to any of paragraphs P-T, wherein the process further comprises adding one or more additional detergent adjuncts to the liquid base composition, to the combined composition, to the detergent composition, or to combinations thereof.

V. A process according to any of paragraphs P-U, wherein the process further comprises a filling step, wherein the detergent composition is placed into a container, preferably wherein the filling step occurs less than about 10 minutes after the amine oxide surfactant is added to the liquid base composition.

Test Methods

Viscosity

The viscosity is measured with a viscometer, such as the Brookfield RVD VII+, according to the manufacturer's instructions. Viscosity is measured using cup and bob geometry configuration in which Spindle #31 rotated at 60 rpm to obtain an approximate shear rate of 20 s−1. The viscosity is then measured at 21° C.

Aeration

Simulated aeration was created by mixing the surfactant composition using a speed mixer, such as the Speedmixer by Hauschild (DAC 600 FVZ) putting approximately 80 mL of sample into a 100 mL sample container and then spinning for 2300 rpm for 2 minutes. Following mixing, visual assessment of aeration was taken at stated intervals (e.g., every 15 minutes) or times.

EXAMPLES

The examples provided below are intended to be illustrative in nature and are not intended to be limiting.

Example 1. Viscosity Differences

To show viscosity difference, two liquid base compositions were prepared. In Leg A, the base composition includes amine oxide; in Leg B, the base composition does not. Following preparation, each base composition is "finished" with additional ingredients to arrive at the following liquid detergent compositions. Note that in Leg B, in addition to the other components, amine oxide was added as part of the finishing step. Formulations for the base and detergent compositions for Legs A and B are provided in Table 1.

TABLE 1

| | Leg A Active % Levels | | Leg B Active Levels | |
|---|---|---|---|---|
| | Base | Detergent | Base | Detergent |
| Alkyl ethoxylated sulfate (AES) | 11.46 | 7.40 | 11.46 | 7.40 |
| Linear alkyl benzene sulphonate (HLAS) | 2.79 | 1.80 | 2.79 | 1.80 |
| DTPA (chelant) | 0.53 | 0.34 | 0.53 | 0.34 |
| Sodium tetraborate | 2.01 | 1.30 | 2.01 | 1.30 |
| NaOH | 0.15 | 0.10 | 0.15 | 0.10 |
| Monoethanolamine | 1.11 | 0.72 | 1.11 | 0.72 |
| PEI20* | 0.46 | 0.30 | 0.46 | 0.30 |
| Citric acid | 1.55 | 1.00 | 1.55 | 1.00 |

TABLE 1-continued

| | Leg A Active % Levels | | Leg B Active Levels | |
|---|---|---|---|---|
| | Base | Detergent | Base | Detergent |
| Calcium formate | 0.15 | 0.10 | 0.15 | 0.10 |
| Amine oxide | 0.83 | 0.54 | 0.00 | 0.54 |
| Sodium formate | 0.00 | 0.75 | 0.00 | 0.75 |
| Perfume | 0.00 | 0.55 | 0.00 | 0.55 |
| Water and minors | balance | balance | balance | balance |

*PEI20 is a 600 g/mol molecular weight polyethylenimine core with 20 ethoxylate groups per —NH. Available from BASF (Ludwigshafen, Germany).

The viscosity of each of the compositions is determined according to the test method provided above. Results are provided below in Table 2.

TABLE 2

| | Viscosity (cps) | |
|---|---|---|
| | Leg A | Leg B |
| Base | 1520 (with amine oxide) | 171 (nil-amine oxide) |
| Detergent | 998 | 827 |
| % change from Base to Detergent | −52% | +384% |

The results shown in Table 2 show the surprising degree to which amine oxide can affect the viscosity of a base composition as described in the present disclosure.

For example, as shown in Table 2, the base composition of Leg A, which includes amine oxide, has a greater viscosity than the base composition of Leg B, which does not include amine oxide. Due to the lower viscosity, it is believed that the base composition of Leg B will therefore de-aerate more quickly than the base composition of Leg A. (See, e.g., Example 2 below.)

Additionally, the results in Table 2 show that the base composition of Leg A has a greater viscosity than the resulting detergent composition of Leg A. Leg A may be contrasted with Leg B, where the detergent composition has a greater viscosity than the base composition. Because the viscosity of the Leg B base composition is relatively lower, it is expected to be relatively easier to move, for example via pumping, through a manufacturing line, requiring less energy and leaving less residue and/or requiring less flushing between runs. Adding amine oxide relatively late in the manufacturing process means, for example, that the energy required to pump the higher viscosity detergent composition is kept to a minimum.

To note, the difference in the viscosities of the Leg A and Leg B detergent compositions, while technically different, are not likely to be consumer relevant and may substantially be perceived as the same.

Example 2. De-Aeration Differences

To simulate relative differences in de-aeration time, two base compositions having the following formulations were prepared. Formulation C does not include amine oxide; Formulation D does. (Note: Formulations C and D have the same compositions as the base compositions of Leg B and Leg A, respectively.)

TABLE 3

| | C (nil-amine oxide) | D (with amine oxide) |
|---|---|---|
| Alkyl ethoxylated sulfate (AES) | 11.46 | 11.46 |
| Linear alkyl benzene sulphonate (HLAS) | 2.79 | 2.79 |
| DTPA (chelant) | 0.53 | 0.53 |
| Sodium tetraborate | 2.01 | 2.01 |
| NaOH | 0.15 | 0.15 |
| Monoethanolamine | 1.11 | 1.11 |
| PEI20 | 0.46 | 0.46 |
| Citric acid | 1.55 | 1.55 |
| Calcium formate | 0.15 | 0.15 |
| Amine oxide | 0.00 | 0.83 |
| Water and minors | balance | balance |

Compositions C and D were aerated according to the aeration test method described above. Following the simulated aeration, photographs were taken of each sample at 0, 15, 30, 60, 150, and 240 minutes. The photographs are shown in the table of FIG. 4.

Figure 4:
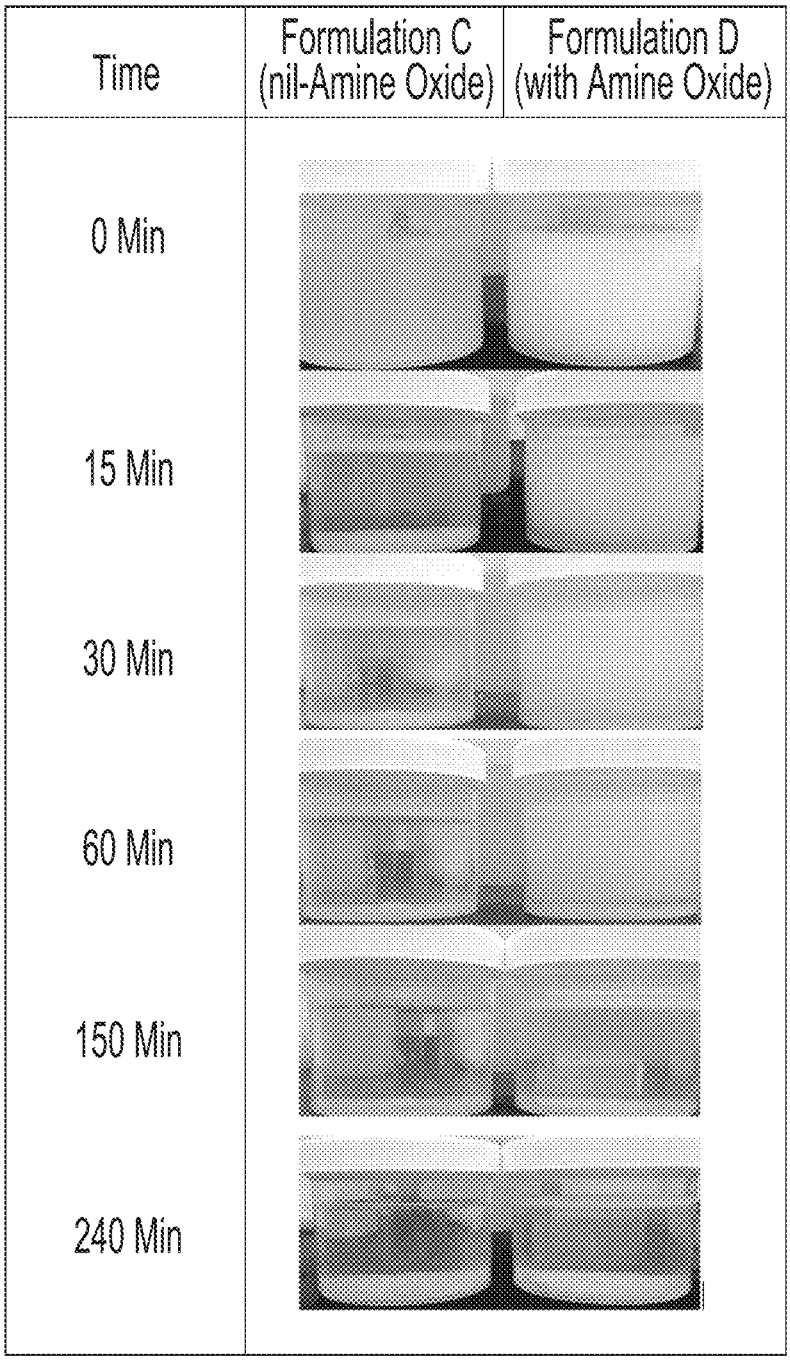
FIG. 4 shows a table that includes photographs showing relative de-aeration of two compositions over time, as described in Example 2 below.

As shown in FIG. 4, both Formulation C and D begin (at 0 min) as opaque and hazy due to significant aeration. However, Formulation C becomes visually transparent much sooner than Formulation D. For example, at 15 minutes, Formulation C is already clearer than Formulation D, and Formulation C achieves significant transparency at 60 minutes, wherein such transparency is reached by Formulation D at 150-240 minutes.

As described in the present disclosure, it is believed that the amine oxide present in Formulation D contributes to greater viscosity in the formulation, which in turn increases the time required for de-aeration. Thus, a base composition such as Formulation C, which does not include amine oxide, is likely to have lower viscosity and will de-aerate more quickly.

To note, the present sample de-aerates quickly (e.g., within about 60 minutes) in part because the gas has a short vertical distance to travel (e.g., only a few centimeters in the given vial). In an industrial setting, however, a base composition may be stored in a storage tank, where the base composition may be present at a depth of at least several meters, and it is believed that de-aeration time should scale linearly with height. In other words, the air bubbles will have a relatively longer distance to travel, the compositions will therefore take longer, as a whole, to de-aerate, and the same trend (nil-amine oxide vs. amine oxide) is expected to be observed.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A process of making a liquid detergent composition, the process comprising the steps of:

providing a manufacturing line comprising, in series and in fluid communication, an upstream region, a confluence region, and a downstream region;

providing a liquid base composition at the upstream region, the liquid base composition comprising at least one surfactant and at least one detergent adjunct, wherein the at least one surfactant is selected from anionic surfactant, nonionic surfactant, or mixtures thereof and wherein the liquid base composition does not contain amine oxide; and combining the liquid base composition with a zwitterionic surfactant in the confluence region, thereby resulting in a detergent composition at the downstream region, wherein the zwitterionic surfactant comprises amine oxide surfactant.

2. A process according to claim 1, wherein the process further comprises adding one or more additional detergent adjuncts to the liquid base composition, the detergent composition, or both.

3. A process according to claim 1, wherein the at least one detergent adjunct comprises a builder, an organic polymeric compound, an enzyme, an enzyme stabilizer, a bleach system, a brightener, a hueing agent, a chelating agent, a suds suppressor, a conditioning agent, a humectant, neat perfume, encapsulated benefit agents, a filler or carrier, or mixtures thereof.

4. A process according to claim 1, wherein the liquid base composition comprises from about 1% to about 75%, by weight of the liquid base composition, of surfactant.

5. A process according to claim 1, wherein the surfactant comprises anionic surfactant selected from alkyl alkoxylated sulfate, alkyl sulfate, alkyl benzene sulphonate, or mixtures thereof.

6. A process according to claim 5, wherein the surfactant comprises alkyl ethoxylated sulfate and alkyl benzene sulphonate.

7. A process according to claim 1, wherein the zwitterionic surfactant further comprises betaine surfactant.

8. A process according to claim 1, wherein the amine oxide surfactant is C10-C18 alkyl dimethyl amine oxide surfactant.

9. A process according to claim 1, wherein the weight ratio of the at least one surfactant of the liquid base composition to the zwitterionic surfactant is at least about 5:1.

10. A process according to claim 1, wherein the detergent composition comprises from about 0.1% to about 2%, by weight of the detergent composition, of zwitterionic surfactant.

11. A process according to claim 1, wherein the base composition has a first viscosity, and wherein the detergent composition has a second viscosity that is greater than the first viscosity.

12. A process according to claim 11, wherein the second viscosity is at least about 125% of the first viscosity.

13. A process according to claim 11, wherein the first viscosity is from about 50 to about 300 cps.

14. A process according to claim 1, wherein the base composition does not comprise an external structurant, and wherein an external structurant is added after the zwitterionic surfactant has been added.

15. A process according to claim 1, wherein the process further comprises a filling step, wherein the detergent composition is placed into a container at a location further downstream of the downstream region.

* * * * *